US005454385A

United States Patent [19]

George

[11] Patent Number: 5,454,385

[45] Date of Patent: Oct. 3, 1995

[54] APPARATUS FOR MAINTAINING HAIR IN A BRAID

[76] Inventor: Edmund S. George, #7, 15 Poirier Ave., St. Albert, Alberta, Canada, T8N 4B5

[21] Appl. No.: 322,150

[22] Filed: Oct. 13, 1994

[51] Int. Cl.[6] ..... A45D 8/34

[52] U.S. Cl. ..... 132/273; 132/275; 132/144

[58] Field of Search ..... 132/144, 219, 132/275, 273, 139, 137, 148

[56] References Cited

U.S. PATENT DOCUMENTS

| | | | |
|---|---|---|---|
| 421,682 | 2/1890 | Dickinson | 132/275 |
| 672,816 | 4/1901 | Bassett | 132/275 |
| 1,359,343 | 11/1920 | Dodge | 132/139 |
| 2,163,524 | 6/1939 | Arpin | 132/139 |
| 2,245,055 | 6/1941 | Schlicker | 132/139 |
| 3,324,865 | 6/1967 | Battaglia | 132/148 |

*Primary Examiner*—John G. Weiss
*Assistant Examiner*—Elise P. Speaks
*Attorney, Agent, or Firm*—Anthony R. Lambert

[57] ABSTRACT

An apparatus for maintaining hair in a braid is describe which includes of an elongate body having a top surface, a first end and a second end. A comb is transversely positioned at the first end. A plurality of pegs extend upwardly from the top surface of the body. The pegs are spaced at intervals between the first end and the second end to define a plurality of hair receiving spaces. Strands of hair are interwoven by being laid in a zig-zag fashion into the spaces between the pegs. The interwoven hair is secured to the top surface at the second end of the elongate body, thereby preventing the interwoven strands of hair from unravelling. Decorative caps can be placed on the pegs to maintain the strands of hair in the hair receiving spaces and for decorative purposes.

8 Claims, 4 Drawing Sheets

APPARATUS FOR MAINTAINING HAIR IN A BRAID

FIELD OF THE INVENTION

The present invention relates to an apparatus for maintaining long hair in a braided condition.

BACKGROUND OF THE INVENTION

A braid is created by interweaving strands of hair. Once the hair has been interwoven to form a braid, the means of maintaining the hair in the braided condition are limited. Most frequently, an elastic band is placed towards the end of the strands of hair to prevent the braid from unravelling.

SUMMARY OF THE INVENTION

What is required is an alternative to an elastic band for maintaining hair in a braided condition.

According to the present invention there is provided an apparatus for maintaining hair in a braid which is comprised of an elongate body having a top surface, a first end and a second end. A comb is transversely positioned at the first end. A plurality of pegs extend upwardly from the top surface of the body. The pegs are spaced at intervals between the first end and the second end to define a plurality of hair receiving spaces. Strands of hair are interwoven by being laid in a zig-zag fashion into the spaces between the pegs. Means are provided for securing interwoven hair to the top surface at the second end of the elongate body, thereby preventing the interwoven strands of hair from unravelling.

The apparatus for maintaining hair in a braid as described above, functions extremely well and provides a viable alternative to an elastic. However, even more beneficial results may be obtained when caps are positioned at on ends of the pegs remote from the top surface. The caps maintain the strands of hair in the hair receiving spaces. If decorative caps are used, they greatly enhance the appearance of the hair.

Although beneficial results may be obtained through the use of the apparatus for maintaining hair in a braid, as described above, even more beneficial results may be obtained when the decorative caps are removably secured to the remote ends. When the decorative caps are removable, they can be removed so they do not interfere with the braiding process. When the decorative caps are removable, a selection of alternative decorative caps can be maintained in a variety of colours and designs to match colours in a wearers outfit and suit a particular occasion.

Some means must be used to prevent the braid which has been formed from unravelling. It is preferred that a transverse bridge member be used that defines and overlies a hair receiving passage. It is also preferred that the bridge member be removably secured between two pegs. This simplifies the braiding process and allows the apparatus to become a fashion accessory, as previously described in relation to the decorative caps.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
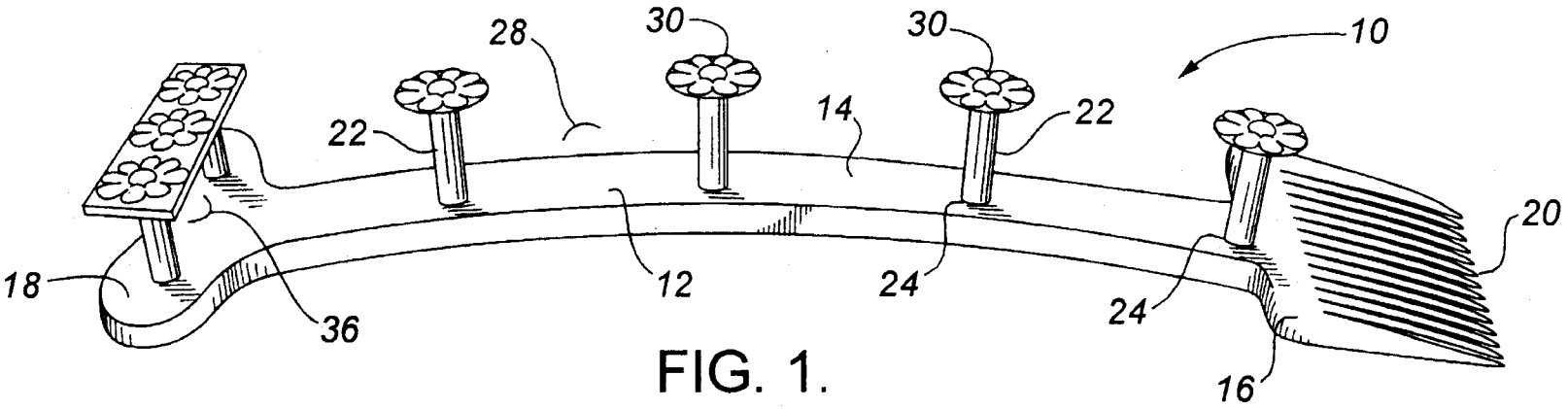
FIG. 1 is a perspective view of an apparatus for maintaining hair in a braid fabricated in accordance with the teachings of the present invention.

The preferred embodiment, an apparatus for maintaining hair in a braid generally identified by reference numeral 10, will now be described with reference to FIGS. 1 through 5.

Figure 2:
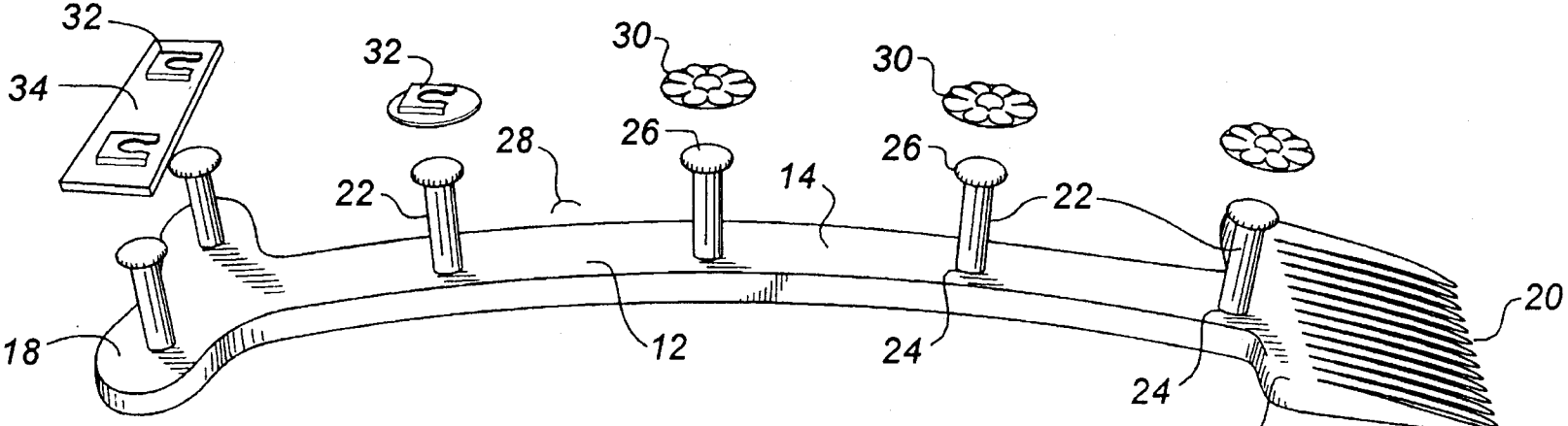
FIG. 2 is an exploded perspective view of the apparatus for maintaining hair in a braid illustrated in FIG. 1.

Referring to FIG. 2, apparatus 10 consists of a generally planar elongate body 12 having a top surface 14, a first end 16 and a second end 18. A comb 20 is transversely positioned at first end 16. Comb 20 is integrally formed out of elongate body 12. A plurality of pegs 22 extend upwardly from top surface 14 of elongate body 12. Each of pegs 22 has an attachment end 24 attached to top surface 14 and a bulbous remote end 26. Pegs 22 are spaced at intervals and extend between first end 16 and second end 18 to define a plurality of hair receiving spaces 28. Decorative caps 30 are provided which have "U" shaped transverse sockets 32. Decorative caps 30 are intended to be attached to remote ends 26 of pegs 22, as illustrated in FIG. 1 and hereinafter described. Referring to FIG. 2, a transverse bridge member 34 is positioned at second end 18 of elongate body 12. Bridge member 34 has two of "U" shaped transverse sockets 32. Referring to FIG. 1, bridge member 34 defines and overlies a hair receiving passage 36.

Figure 3:
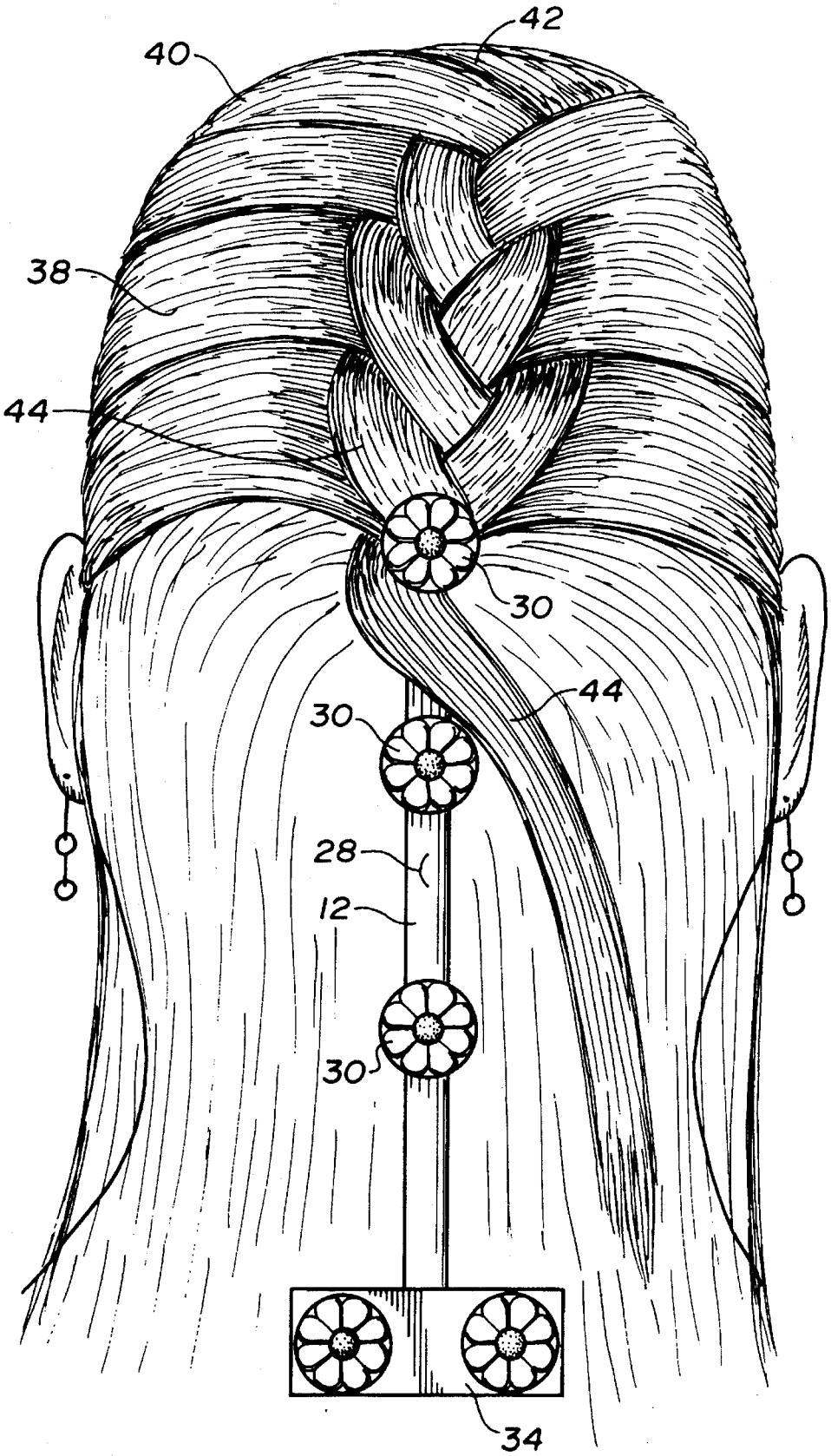
FIG. 3 is a top plan view of the apparatus for maintaining hair in a braid illustrated in FIG. 1, positioned in hair during the early stages of braiding.
Figure 4:
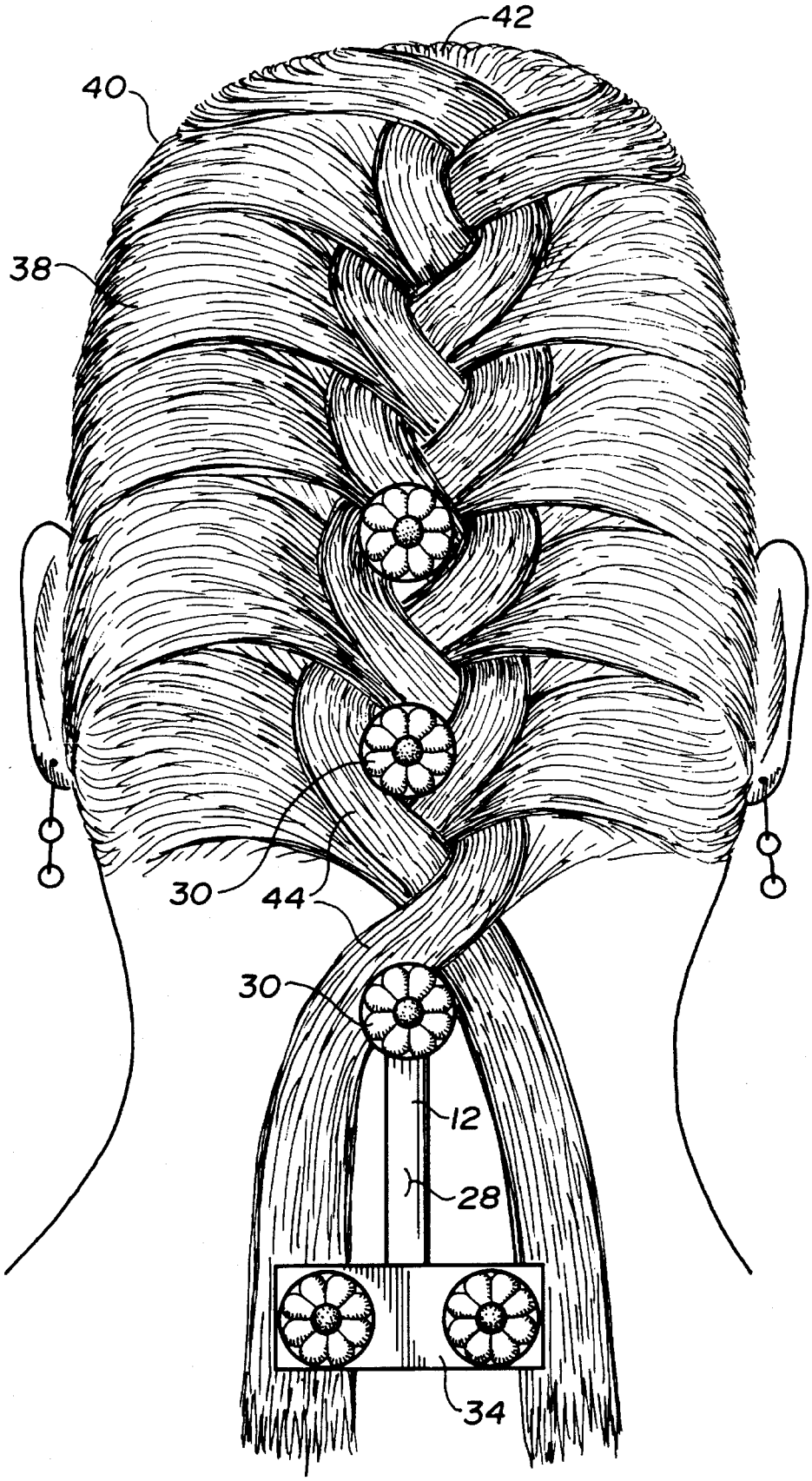
FIG. 4 is a top plan view of the apparatus for maintaining hair in a braid illustrated in FIG. 1, positioned in hair during the later stages of braiding.
Figure 5:
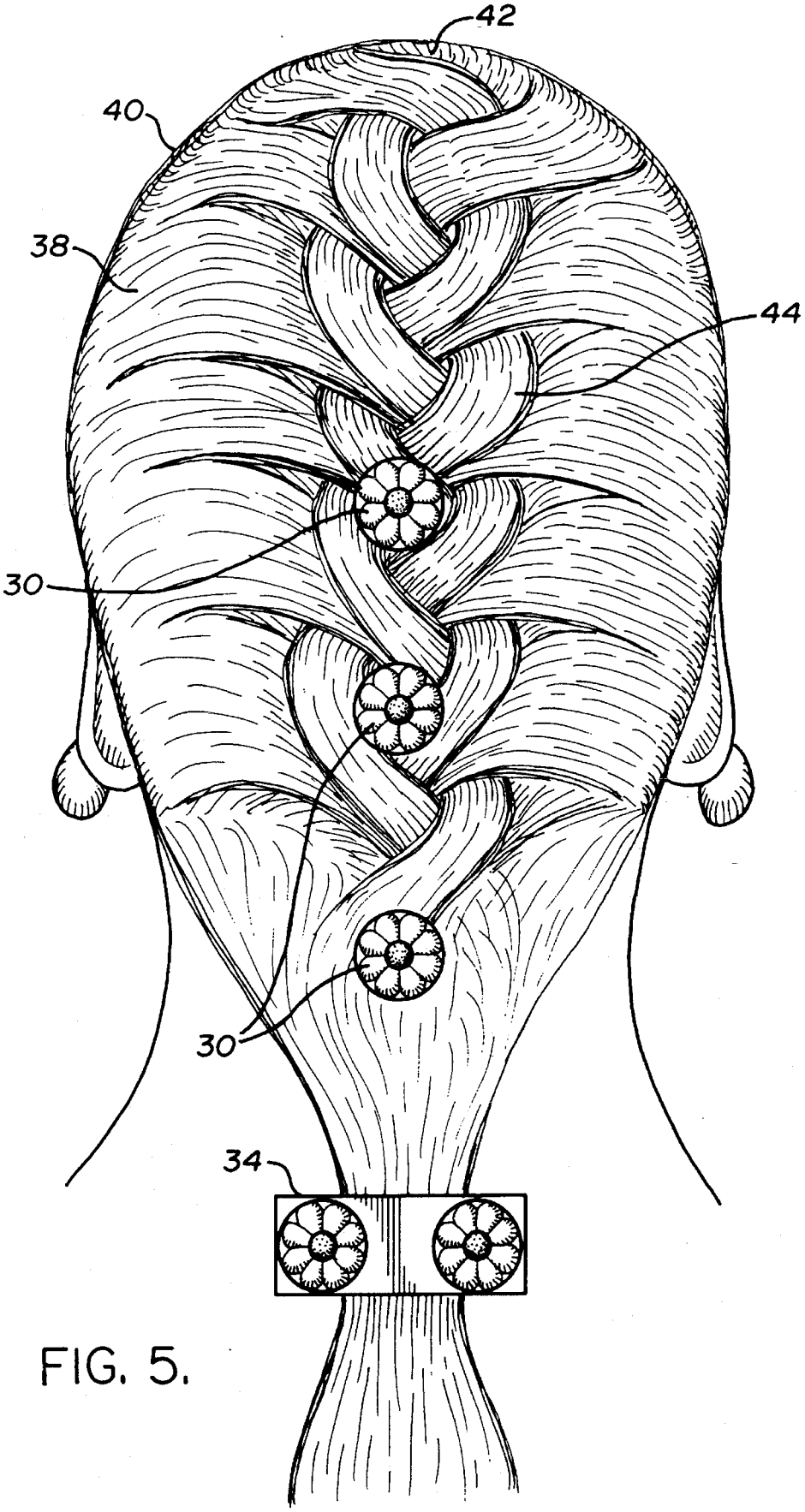
FIG. 5 is a top plan view of the apparatus for maintaining hair in a braid illustrated in FIG. 1, positioned in hair once the braiding process has been completed.

The use and operation of apparatus 10 will now be described with reference to FIGS. 1 through 5. Referring to FIG. 3, comb 20 is inserted into hair 38 high up on a persons head 40 approaching their crown 42, such that comb 20 is hidden from view and pegs 22 remain exposed. Referring to FIGS. 3 and 4, strands of hair 44 are then interwoven by being laid in a zig-zag fashion into hair receiving spaces 28 between pegs 22. During this procedure decorative caps 30 can either be left in position or detached. If they are detached, they can be reattached by engaging transverse sockets 32 with bulbous remote ends 26 of pegs 22. Referring to FIG. 5, at the end of the braiding process strands of hair 44 which have been interwoven around pegs 22 by laying in hair receiving spaces 28, is then extended through hair receiving passage 36 under bridge 34. This secures strands of hair 44 to top surface 14 sufficiently to prevent strands of hair 44 from passing back around pegs 22 and unravelling. Bridge 34 can be removed to simplify the braiding process. As with decorative caps 30, if bridge 34 is removed it can be reattached by engaging transverse sockets 32 with bulbous remote ends 26 of pegs 22. It should be noted that once the braiding process is complete only decorative caps 30 and bridge 34 remain visible. It is preferred that bridge 34 be decorated in a manner that is compatible with decorative caps 30.

It will be apparent to one skilled in the art that modifications may be made to the illustrated embodiment without departing from the spirit and scope of the invention as defined by the claims.

The embodiments of the invention in which an exclusive property or privilege is claimed are as follows:

1. An apparatus for maintaining hair in a braid, comprising:

an elongate body having a top surface, a first end and a second end;

a comb transversely positioned at the first end;

a plurality of pegs extending upwardly from the top surface of the body, the pegs being spaced at intervals between the first end and the second end to define a plurality of hair receiving spaces, such that strands of hair are interwoven by being laid in a zig-zag fashion into the spaces between the pegs; and means positioned at the second end of the elongate body for securing interwoven hair to the top surface, thereby preventing the interwoven hair from unravelling.

2. The apparatus for maintaining hair in a braid as defined in claim 1, wherein caps are positioned on ends of the pegs remote from the top surface.

3. The apparatus for maintaining hair in a braid as defined in claim 2, wherein the caps are decorative.

4. The apparatus for maintaining hair in a braid as defined in claim 2, wherein the caps are removably secured to the remote ends.

5. The apparatus for maintaining hair in a braid as defined in claim 1, wherein the means for securing interwoven hair consists of a transverse bridge member that defines and overlies a hair receiving passage.

6. The apparatus for maintaining hair in a braid as defined in claim 5, wherein the bridge member is removably secured between two pegs.

7. The apparatus for maintaining hair in a braid as defined in claim 5, wherein the bridge member is decorative.

8. An apparatus for maintaining hair in a braid, comprising:

a generally planar elongate body having a top surface, a first end and a second end;

a comb transversely positioned at the first end;

a plurality of pegs extending upwardly from the top surface of the body, each peg having an attachment end attached to the top surface and a bulbous remote end, the pegs being spaced at intervals between the first end and the second end to define a plurality of hair receiving spaces, such that strands of hair are interwoven by being laid in a zig-zag fashion into the spaces between the pegs;

decorative caps having "U" shaped transverse sockets by means of which the decorative caps are removably secured to the bulbous remote ends of the pegs; and a transverse bridge member positioned at the second end of the elongate body, the bridge member having two "U" shaped transverse sockets by means of which the bridge member is removably secured to bulbous remote ends of two pegs to define and overlie a hair receiving passage thereby securing interwoven hair extending through the hair receiving passage to the top surface to prevent the interwoven hair from unravelling.

* * * * *